United States Patent [19]

Vos et al.

[11] Patent Number: 4,999,063

[45] Date of Patent: Mar. 12, 1991

[54] PROCESS FOR MANUFACTURING A GAS GENERATING MATERIAL

[75] Inventors: Thomas H. Vos, Rochester; James M. Kumkoski, Utica, both of Mich.; Leo S. Knowlden, Gilbert, Ariz.; George W. Goetz, Rochester Hills, Mich.

[73] Assignee: TRW Vehicle Safety Systems Inc., Lyndhurst, Ohio

[21] Appl. No.: 535,116

[22] Filed: Jun. 7, 1990

[51] Int. Cl.[5] ..... D03D 23/00

[52] U.S. Cl. ..... 149/109.6; 149/35; 149/110; 149/114; 241/27; 241/29; 264/3.4

[58] Field of Search ..... 149/109.6, 35, 110, 149/114; 264/3.4; 241/27, 29

[56] References Cited

U.S. PATENT DOCUMENTS

| | | | |
|---|---|---|---|
| Re. 32,584 | 1/1988 | Pietz | 149/35 |
| 3,895,098 | 7/1975 | Pictz | 149/35 |
| 3,996,072 | 12/1976 | DiValentin | 149/35 |
| 3,996,079 | 12/1976 | DiValentin | 149/35 |
| 4,243,443 | 1/1981 | Utracki | 149/35 |
| 4,758,287 | 7/1988 | Pietz | 149/35 |
| 4,817,828 | 4/1989 | Goetz | 102/288 |

OTHER PUBLICATIONS

Article entitled Air Bag Industry Retains Sodium Azide Despite Fires, printed Apr. 9, 1990 issue of Automotive Electronics Journal.

*Primary Examiner*—Stephen J. Lechert, Jr.
*Attorney, Agent, or Firm*—Tarolli, Sundheim & Covell

[57] ABSTRACT

A wet mixture of a metal azide having a predetermined average particle size and a metal oxide is prepared. The wet mixture is ground to reduce at least the average particle size of the metal azide. Thereafter, the wet mixture is directed through a chamber containing grinding media. The grinding media is agitated as the mixture flows through the chamber to further reduce the average particle size of the metal azide to a desired particle size.

16 Claims, 5 Drawing Sheets

PROCESS FOR MANUFACTURING A GAS GENERATING MATERIAL

BACKGROUND OF THE INVENTION

1. Technical Field

The present invention relates to a method for manufacturing gas generating material, and in particular relates to a method for manufacturing a gas generating material which contains an azide and a metal oxide and is used for generating gas to inflate a vehicle occupant restraint, such as an airbag.

2. Description of the Prior Art

U.S. Pat. No. 3,996,079 discloses a process for manufacturing an azide-containing gas generating composition. The dry ingredients of the gas generating composition are mixed together. A liquid is then added to the dry mixture to produce a plastic mass. The plastic mass is then forced through a die, perforated plate, or sieve to form wet granules. The wet granules are then dried.

U.S. Pat. No. 4,758,287 also discloses a process for manufacturing an azide containing gas generating material. In this process, a water slurry of gas generating material is prepared. The slurry is then molded into a desired shape and flash dried.

The particle size of the ingredients in a gas generating material is an important factor relating to performance of the gas generating material. Generally, the smaller the particle size of the ingredient the more active the ingredient when the gas generating material is ignited. Therefore, grinding an ingredient of a gas generating material to reduce its particle size is common practice.

SUMMARY OF THE INVENTION

The present invention relates to a process for manufacturing a gas generating material. The gas generating material is formed by preparing a wet mixture of preferably a metal azide and a metal oxide. During processing of the wet mixture of metal azide and metal oxide, the mixture is repeatedly ground to reduce the average particle size of one or more ingredients of the mixture.

The wet mixture is preferably 45% to 55% by weight solids when it is ground. During the grinding of the wet mixture, the mixture is also preferably cooled to maintain the temperature of the mixture in a desired temperature range of 20° C. to 30° C. and preferably 25° C.±2° C.

The ingredients in the wet mixture are ground to a predetermined average particle size by first flowing the wet mixture through a grinding gap defined by a rotor and a stator. The rotor is rotated relative to the stator to reduce the average particle size of the solids in the wet mixture as the wet mixture flows through the gap. The average particle size of the wet mixture is further reduced by flowing the wet mixture through a chamber containing grinding media. The grinding media are hard, relatively small elements. The grinding media are agitated as the wet mixture flows through the chamber. Thus, the grinding media strike against the solid particles in the wet mixture, and reduce their particle size.

BRIEF DESCRIPTION OF THE DRAWINGS

The foregoing and other features of the present invention will become more apparent to one skilled in the art upon consideration of the following description in connection with the accompanying drawings, wherein.

DESCRIPTION OF A PREFERRED EMBODIMENT OF THE INVENTION

Body of Gas Generating Material

A body 10 (known as a "grain") of gas generating material is used in inflatable vehicle occupant restraint systems to inflate an occupant restraint, such as an airbag. The body 10, or a plurality of bodies 10, of gas generating material could be used in many different types of inflatable restraint systems. One inflatable restraint system in which the bodies of gas generating material may be used is described in U.S. Pat. No. 4,817,828, assigned to the assignee of the present application, issued April 4, 1989 and entitled "Inflatable Restraint System".

The body 10 of gas generating material includes a fuel which is a source of nitrogen gas and a primary oxidizer which is a primary source of oxygen. The body 10 of gas generating material also contains a secondary oxidizer, extruding aid and strengthening fibers. The preferred fuel or source of nitrogen gas is an alkali metal azide, such as sodium azide, potassium azide or lithium azide. Sodium azide is the most preferred alkali metal azide. The primary oxidizer is preferably a metal oxide. The metal of the metal oxide may be any metal lower in the electromotive series than the alkali metal. Examples of preferred metals are iron, copper, manganese, tin, titanium, or nickel, and combinations of such metals. The most preferred primary oxidizer is iron oxide.

The secondary oxidizer in the body 10 may be an alkali metal nitrate, chlorate, and/or perchlorate or combinations of the foregoing. At the present time, it is preferred to use sodium nitrate. The secondary oxidizer modifies the reaction rate. Relatively small amounts of an extrusion aid and strengthening fibers are provided in the body 10 of gas generating material. Bentonite is the preferred extrusion aid. Graphite fibers are preferably used as the strengthening fibers, although glass fibers and/or iron fibers could be used.

The body 10 of gas generating material preferably has the following proportions of ingredients by weight:

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |

-continued

| Ingredient | Amount | Range |
|---|---|---|
| Sodium Nitrate ($NaNO_3$) | 2% | 0 to 10% |

The body 10 has a generally cylindrical shape and has a cylindrical central passage 7 with an axis disposed on the central axis of the grain. The passage 7 extends between axially opposite end faces of the body. In addition, the body 10 has a plurality of cylindrical passages 8 which are disposed radially outwardly relative to central passage 7 and which also extend longitudinally through the body between the opposite end faces.

Figure 1:
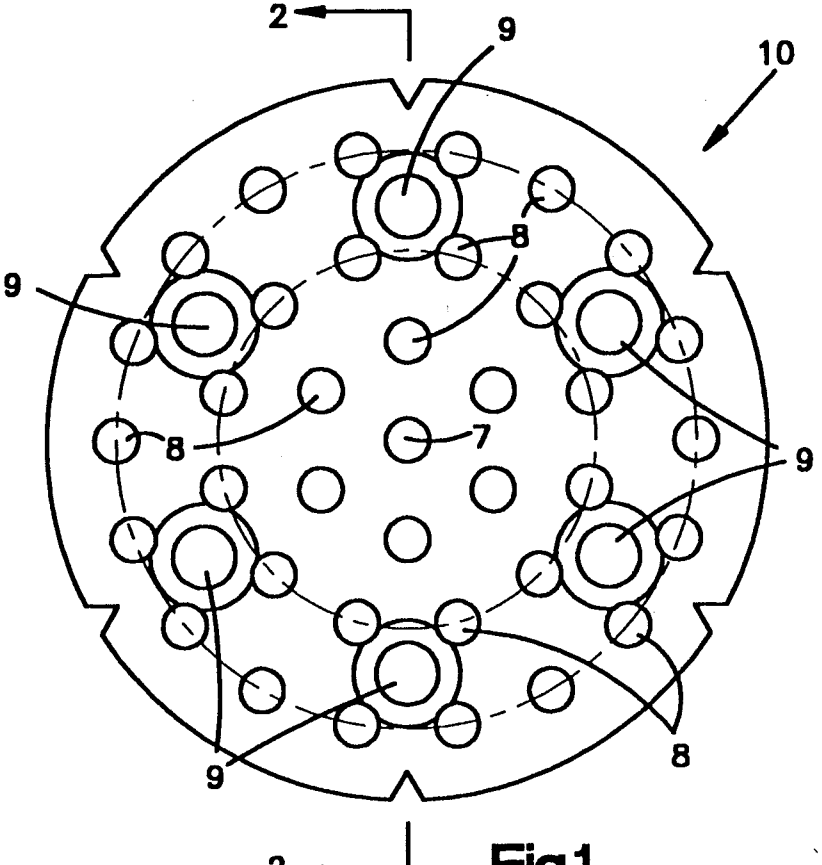
FIG. 1 is a plan view of a body of gas generating material used in a vehicle occupant restraint system and made of gas generating material manufactured in accordance with the process of the present invention.

The axes of the passages 8 are parallel to the axis of passage 7. The passages 8 are evenly spaced, on concentric circles which are radially spaced from passage 7, but co-axial with the axis of passage 7. As shown in FIG. 1, the axes of the passages 8 on one of the concentric circles are offset circumferentially, to one side, from the axes of the passages 8 on the other concentric circles. In this respect, a passage 8 on a first concentric circle is spaced from an offset passage on an adjacent concentric circle the same distance that it is spaced from an adjacent passage 8 on its concentric circle. The plurality of passages 7, 8 in a body 10 promote a progressive rate of burn of the body. A progressive rate of burn is one in which the burning proceeds, for a substantial part of the burn cycle, at a rate which increases.

When used to inflate an airbag, the plurality of bodies 10 are stacked so that the passages in one body are aligned with the passages in all of the other bodies. Thus, hot gas generated by burning one body flows through the passage to ignite adjacent bodies and the surfaces of the passages of all of the bodies are quickly ignited.

The gas which is generated within the passages must be able to get out of the passages and flow radially of the bodies into a airbag to inflate the airbag. To provide for such flow, spaces are provided between the end faces of adjacent bodies 10. The spaces extend radially outward from the central passage 7 of the bodies. The spaces between the ends of adjacent bodies are provided by axially projecting standoff pads 9 on the end faces. As disclosed in prior U.S. Pat. No. 4,817,828, the standoff pads of one body are aligned with those of an adjacent body so that the spaces between the bodies are provided by the standoff pads of adjacent bodies. Several standoff pads 9 are positioned in circumferentially spaced apart relationship on each end face so as to maintain the end faces of adjacent bodies in spaced apart parallel planes.

Figure 3:
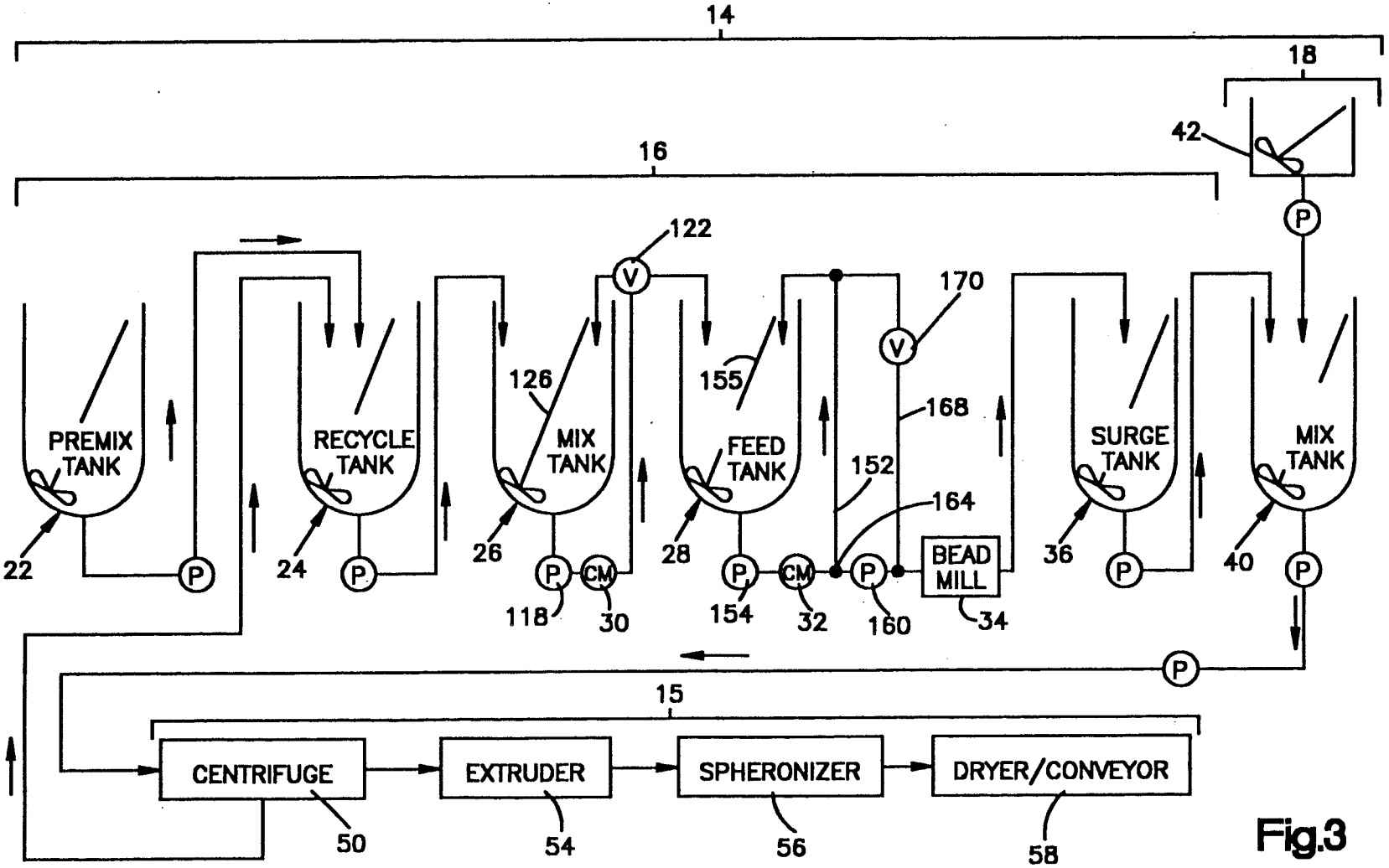
FIG. 3 is a schematic illustration depicting process equipment used in a process of manufacturing gas generating material for forming the body of gas generating material illustrated in FIGS. 1 and 2.

The gas generating material used in the body 10 is manufactured in a process using the apparatus illustrated schematically in FIG. 3. The process herein described is applicable to the manufacture of bodies having a multitude of pressed or extruded shapes, the preferred being shown in FIG. 1. The apparatus of FIG. 3 includes a first stage of process equipment 14 which is used to prepare a wet mixture of the gas generating material and a second stage of process equipment 15 which is used to process the wet mixture of gas generating material. The first stage of process equipment for preparing a wet mixture of gas generating material includes preliminary process equipment 16 for use in preparing a first or initial wet mixture of gas generating material and secondary process equipment 18 for use in preparing a second or final wet mixture of the gas generating material.

The preliminary process equipment 16 is used to prepare an aqueous based initial wet mixture of sodium azide ($NaN_3$), iron oxide ($Fe_2O_3$) and sodium nitrate ($NaNO_3$). This is done without mixing the sodium azide and iron oxide in dry form. The preliminary process equipment includes a premix tank 22 where sodium azide and sodium nitrate are mixed with fresh water to form a saturated solution. The saturated solution in the premix tank 22 is conducted from the premix tank to a recycle tank 24. In the recycle tank 24, recycled liquid from a previous wet mixture of gas generating material is added to the saturated solution from the premix tank 22. The recycled liquid has the same ingredients in the same proportions as the saturated solution in the premix tank 22. However, the recycled liquid may contain trace amounts of ingredients not found in the saturated solution in the premix tank 22.

From the recycle tank 24, the saturated solution is conducted to a main mix tank 26. In the main mix tank 26, sodium azide powder and iron oxide powder are added to the wet mixture. The sodium azide particles are generally spherical in shape with an average particle diameter of about 180 microns (referred to herein as average particle size). The iron oxide particles are generally rectangular in cross section and have an average largest dimension of 0.2 microns (referred to herein as average particle size). The main mix tank 26 preferably contains 51.5% by weight of solution from the recycle tank, 19.1% by weight of iron oxide, and 29.4% by weight of sodium azide. Thus, the wet mixture in the main mix tank 26 is preferably 48.5% solids. However, the wet mixture in the main mix tank 26 may be between 45% and 55% solids to facilitate grinding of the wet mixture.

The wet mixture is then conducted from the main mix tank 26 to a feed tank 28. In the feed tank 28, the various ingredients of the initial wet mixture of gas generating material are further mixed to form a homogeneous mixture.

The wet mixture from the main mix tank 26 is recirculated by a pump 118 through a colloid mill 30 for at least twenty minutes before being conducted from the main mix tank 26 to the feed tank 28. A valve 122 controls the flow from the colloid mill 30 and directs it either back to the mix tank 26 or to the feed tank 28. By recirculating the wet mixture and mixing the mixture in the tank with a mixer 126, a homogeneous mixture is obtained. The wet mixture in the main mix tank makes a minimum of six passes through the colloid mill 30 to grind the sodium azide particles in the wet mixture. The iron oxide particles being small are not reduced in size by the colloid mill 30.

After the wet mixture in the main mix tank 26 has been recirculated through the colloid mill 30 for at least twenty minutes, the solenoid valve 122 is actuated to direct a flow of the wet mixture into the feed tank 28. The valve 122 stays actuated, that is directing the flow of the wet mixture into the feed tank 28, until an upper liquid level sensor (not shown) detects that a maximum level has been obtained in the feed tank 28. When a liquid level sensor (not shown) detects a minimum level in the tank, the solenoid valve 122 is again actuated to circulate the wet mixture to the feed tank 28.

The wet mixture in the feed tank 28 is recirculated through a colloid mill 32 and a conduit 152 by a pump 154 to provide a homogeneous mixture in feed tank 28.

A mixer 155 in the feed tank 28 further promotes the maintenance of a homogeneous mixture in the feed tank.

During recirculation of the wet mixture by the pump 154, a screw-type pump 160 maintains a continuous flow of the wet mixture to a bead mill 34. Thus, at a T connection 164, the flow of the wet mixture from the colloid mill 32 is divided, with the majority of the flow going back to the feed tank 28 through the conduit 152. However, a portion of the flow of the wet mixture from the colloid mill 32 is conducted from the open T connection 164 to the pump 160 and bead mill 34. In the specific embodiment of the apparatus illustrated in FIG. 3, the T connection 164 is sized to split the flow of the wet mixture from the feed tank 28 in a fourteen to one ratio. Thus, fourteen times as much of the wet mixture is conducted through the recirculating conduit 152 as is conducted to the pump 160 through the T connection 164.

The wet mixture continuously flows from the bead mill 34 into a surge tank 36. If the bead mill 34 should, for some unforeseen reason, become plugged or otherwise fail, the wet mixture is conducted through a conduit 168 to a combination pressure relief and check valve 170. When the fluid pressure in the conduit 168 exceeds a predetermined maximum pressure, the valve 170 opens and there is a flow of the wet mixture through the conduit 168 back to the feed tank 28.

The bead mill 34 continuously grinds a flow of the wet mixture from the pump 160. The wet mixture is cooled in the bead mill 34 to maintain the wet mixture within a temperature range of between 20° C. and 30° C., and preferably at a temperature of 25° C.±2° C. A temperature sensor (not shown) is provided after the bead mill 34 to sense the temperature of the mixture and control the flow of coolant through the bead mill.

The colloid mills 30 and 32 are effective to grind the sodium azide from an average particle size of approximately 180 microns to an average particle size of approximately 80 microns. The bead mill is effective to grind the sodium azide particles from an average particle size of 80 microns to an average particle size of less than 5 microns. The colloid mills 30, 32 and the bead mill 34 do not change the average particle size of the iron oxide.

The secondary process equipment 18 for preparing a second or final wet mixture includes a second main mix tank 40 which receives the initial wet mixture of gas generating material from the surge tank 36. Graphite slurry from a graphite slurry tank 42 is added to the initial wet mixture in the second main mix tank 40. In addition, bentonite powder is added to the first or initial mixture in the second main mix tank 40. The addition of the graphite slurry and bentonite to the wet mixture in the tank 40 completes the preparation of the wet mixture of gas generating material.

From the second main mix tank 40, the second wet mixture of gas generating material is conducted to the second stage process equipment 15. The process equipment 15 includes a centrifuge 50 where liquid is removed from the wet mixture of gas generating material. The liquid removed from the wet mixture of gas generating material is conducted back to the recycle tank 24 and reused.

The wet mixture of gas generating material from the centrifuge 50 is conducted to an extruder 54. The extruder 54 forms the wet mixture of gas generating material into generally cylindrical extrudate. This is done by forcing the wet mixture of gas generating material through small openings.

Figure 2:
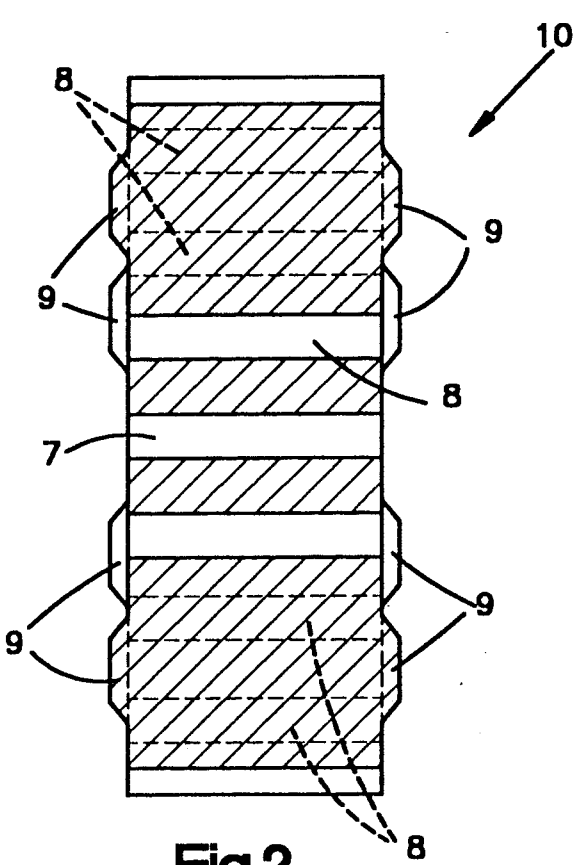
FIG. 2 is a sectional view, taken along the line 2—2 of FIG. 1, further illustrating the construction of the body of gas generating material.

The cylindrical extrudate of gas generating material are formed into a spherical shape by a spheronizer 56. The spherical granules of gas generating material are then conducted to a conveyor dryer 58 in which they are dried as they move through the dryer. The spherical granules are subsequently pressed, in a known manner, to form the bodies 10 (FIGS. 1 and 2) of gas generating material.

There is a tendency for hydrazoic acid ($HN_3$) to form in the premix tank 22, recycle tank 24, mix tank 26 and mix tank 40. Hydrazoic acid fumes are toxic and should be avoided. High concentrations of hydrazoic acid fumes are also explosive. Further, the formation of hydrazoic acid consumes sodium azide, thereby affecting the amount of sodium azide in the mixture in the tank. To prevent the formation of hydrazoic acid in tanks 22, 24, 26, and 40, the pH of the mixture in the tanks is maintained at or above 10.5 and preferably at 11 or above. The pH of the mixture in the tanks is sensed by a probe. Whenever the probe senses that the pH of the saturated solution in a tank is approaching 10.5, a metering pump (not shown) is operated. Operation of the metering pump conducts a metered flow of sodium hydroxide from a sodium hydroxide tank (not shown) to the appropriate tank 22, 24, 26 and 40. When the probe senses that the pH of the saturated solution in the tank has increased to or slightly above 11, the flow of sodium hydroxide into the tank is stopped.

The amount of sodium azide which can be dissolved in a given amount of water increases as the temperature of the water increases. Therefore, the wet mixture of gas generating material is maintained throughout the process as close as possible to 25° C.±2° C. and at least between 20° C. to 30° C, including in the colloid mills and the bead mill. If this temperature is not maintained, the gas generating material may have too little or too much azide in the final product.

Apparatus

Figure 4:
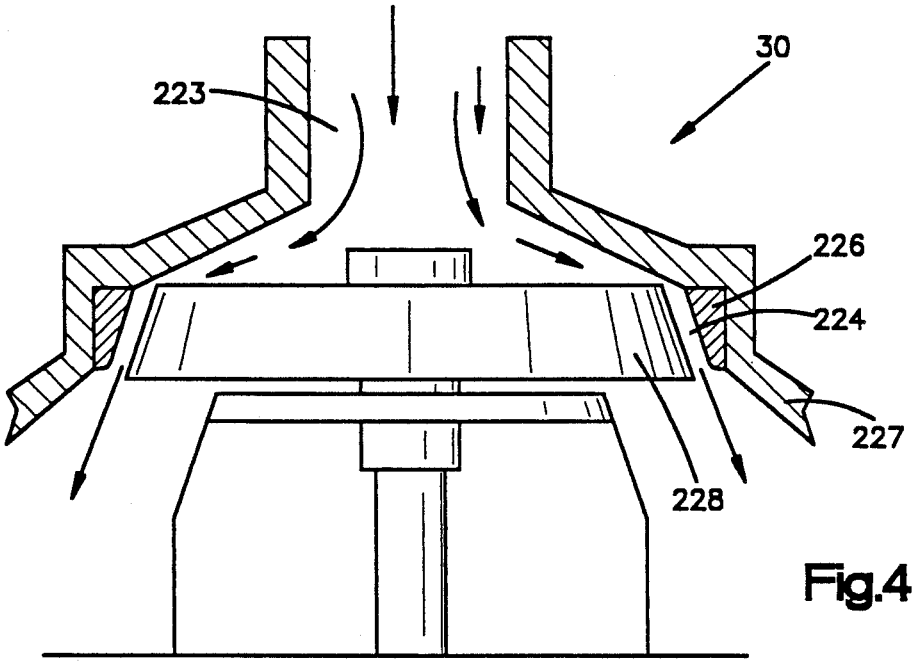
FIG. 4 is a schematic illustration of a colloid mill used in the apparatus of FIG. 3.

The colloid mill 30 is schematically illustrated in FIG. 4. The colloid mill 30 has an inlet 223 through which the wet mixture from the main mix tank 26 enters the colloid mill. The wet mixture from the main mix tank passes through a narrow grinding gap 224 between an annular inner side surface of a stator 226 and an annular outer side surface of a rotating rotor 228. The solid particles in the wet mixture are reduced in size as the particles flow through the gap 224. The grinding gap between the rotor and stator is adjustable between 0.001 and 0.125 of an inch. The specific grinding gap provided in the colloid mill 30 will depend upon the size of the particles used in forming the wet mixture of gas generating material. As the wet mixture from the main mix tank 26 passes through the gap 224, the particles in the wet mixture are ground.

Although the construction of only the colloid mill 30 has been illustrated in FIG. 4, it should be understood that the colloid mill 32 has the same construction as the colloid mill 30. The colloid mills 30, 32 are cooled by a flow of cooling liquid through jackets (not shown) around the stator 226 and the spillway 227 along which the wet mixture of gas generating material is conducted from the grinding gap. They are cooled to maintain the temperature of the wet mixture at 20° C. to 30° C. and preferably at 25° C.±2° C.

Figure 5:
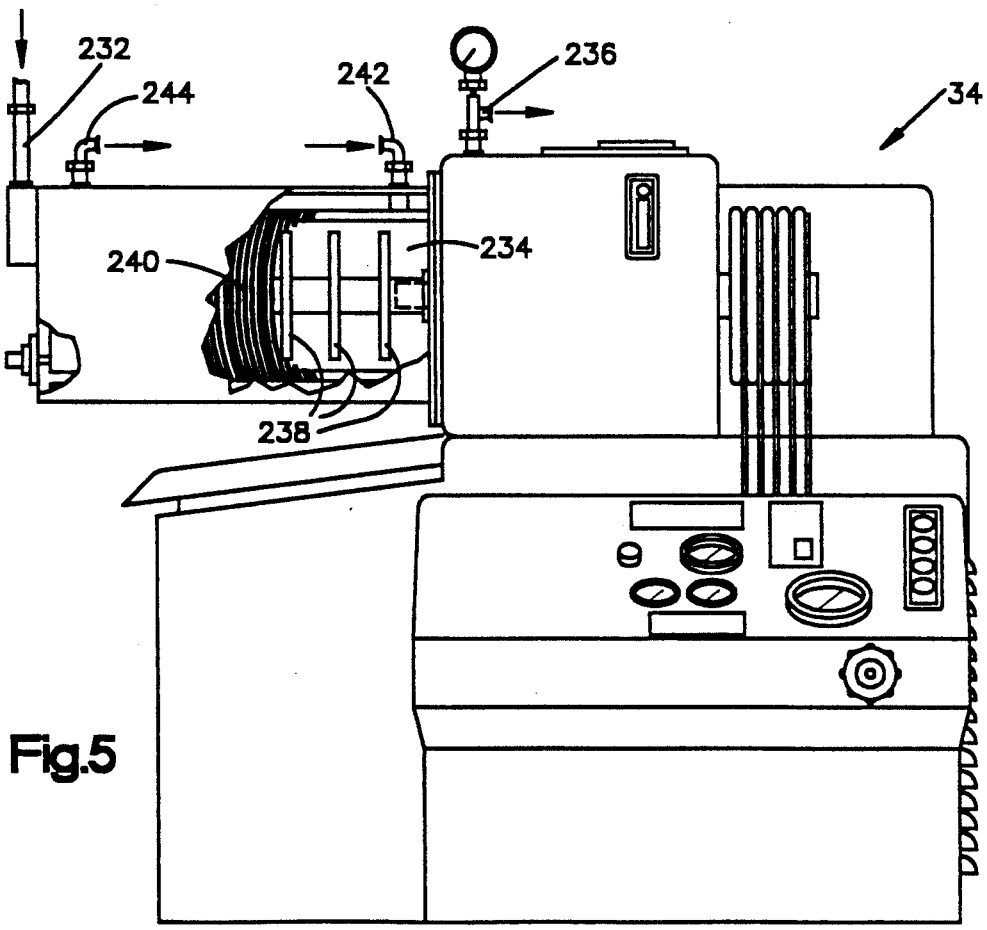
FIG. 5 is a partially broken away schematic illustration of a bead mill used in the apparatus of FIG. 3.

The construction of the bead mill 34 is illustrated in FIG. 5. The bead mill 34 has an inlet 232 through which the wet mixture from the feed tank 28 is pumped by the metering pump 160 (FIG. 3). There is a continuous flow of the wet mixture through a cylindrical grinding chamber 234 to an outlet 236.

The grinding chamber 234 is 80% full of grinding media which comprises spherical zirconia beads having a diameter of approximately one millimeter. A plurality of circular, open-centered, disks 238 rotate at a speed of 1,150 to 1,600 rpm in the grinding chamber 234 to agitate the zirconia beads. This results in the solids in the wet mixture of gas generating material being subjected to intense impact and high shear loads created by the zirconia beads contacting the solids. Also, the particles of the solids come into intimate contact as they flow through the grinding chamber 234. The grinding chamber 234 of the bead mill 34 is enclosed by a spiral cooling coil 240. Liquid coolant is conducted from an inlet 242 through the cooling coil 240 to an outlet 244 to cool the wet mixture in the grinding chamber 234. To maintain the temperature of the wet mixture at 20° C. to 30° C. and preferably at 25° C.±2° C.

When the wet mixture of gas generating material is moving through the grinding chamber 234, the wet mixture is between 45% and 55% solids by weight and preferably 48.5% solids. If the amount of solids is less than 45%, it has been found that the zirconia elements in the bead mill 34 tend to grind themselves, while if the wet mixture contains more than 55% solids, the bead mill 34 tends to plug. Many different types of bead mills could be used other than the specific bead mill disclosed.

The centrifuge 50 reduces the moisture content of the wet mixture of gas generating materials to between about 7% and about 11% and preferably about 9%. Although different centrifuges may be used, the centrifuge 50 preferably contains a known inverting filter for assisting in discharging the filter cake from the centrifuge.

Figure 6:
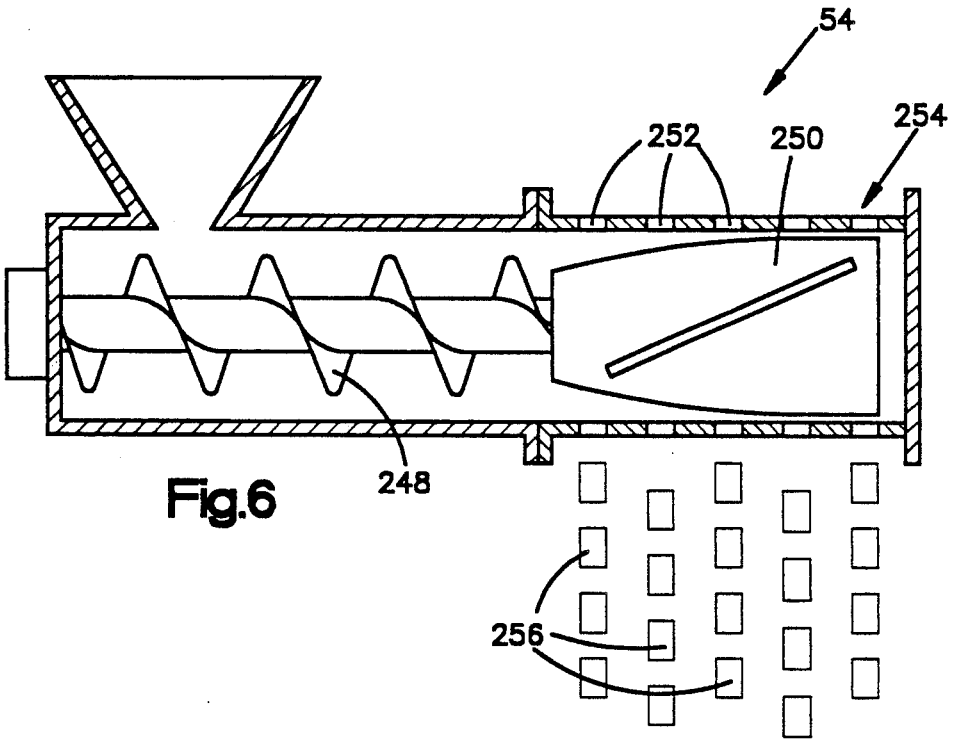
FIG. 6 is a schematic illustration of an extruder used in the apparatus of FIG. 3.

The extruder 54 (FIG. 6) is of the screw-type and has a feed screw 248 which feeds the wet mixture of gas generating material to an extruder head 250. The extruder head 250 forces the wet mixture of gas generating material through small openings 252 formed in a cylindrical die plate 254. The wet mixture of gas generating material, having a moisture content of approximately 9%, is forced through the openings 252 and is formed into cylindrical extrudate 256. Preferably, the extruder 54 is a twin screw type extruder. Each of the screws has a coolant flowing through a cooling passage in the screw.

Figure 7:
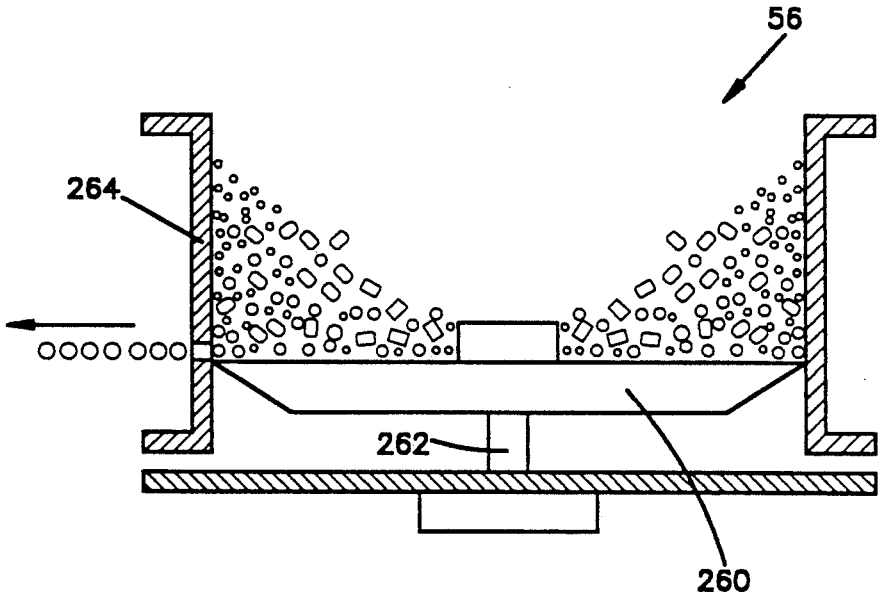
FIG. 7 is a schematic illustration of a spheronizer used in the apparatus of FIG. 3.
Figure 8:
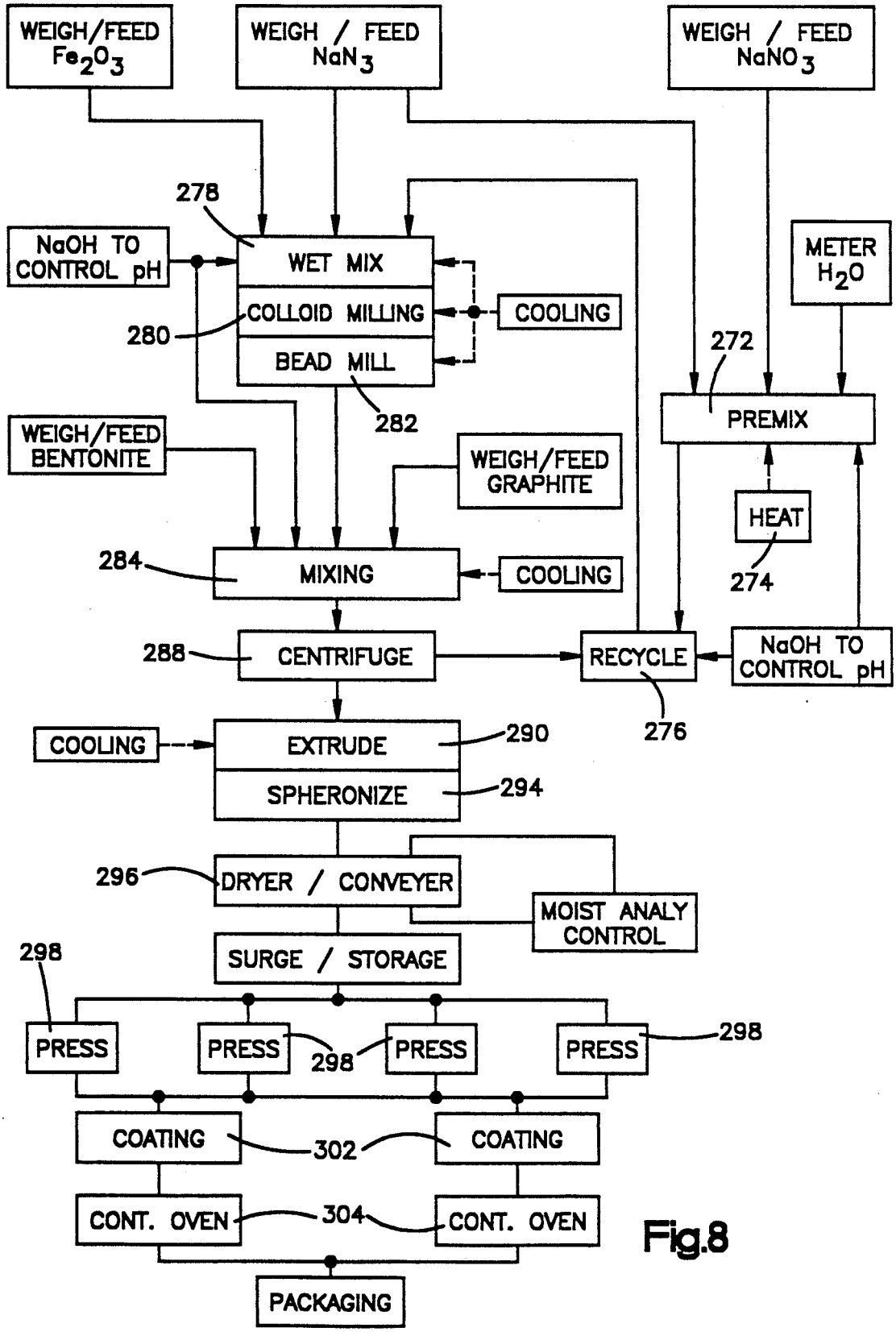
FIG. 8 is a schematic illustration of the processing steps of the present invention.

The construction of the spheronizer 56 is illustrated schematically in FIG. 7. The spheronizer 56 has a circular disk 260 which is rotated by a drive shaft 262. The upper surface of the disk 260 is formed with two sets of groove which intersect at right angles.

The cylindrical extrudate 256 from the extruder 54 are placed on the disk 260 near its center. The high speed rotating disk 260 centrifugally urges the extrudate 256 radially outwardly on the disk. As this occurs, the material 256 is hurled against the inside wall of a cylindrical bowl 264. Centrifugal and gravitational forces create a mechanically fluidized ring of material which rotates against the plate 260 and the wall 264. As the material rotates, it breaks into shorter lengths, tumbling and gradually changing shape from cylindrical to spherical. The bowl 264 may be heated to prevent the material from sticking to the bowl by flowing a heated liquid through passages in the wall of the bowl.

In the foregoing description, the flow of the various materials has been described in a manner which corresponds to manual actuation of the various control elements. However, it is contemplated that the process may be controlled, in whole or in part, by a computer.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, the following is claimed:

1. A process comprising the steps of:

preparing a wet mixture of powder ingredients, at least one of said powder ingredients having a predetermined average particle size;

directing the wet mixture at least once through a grinding gap defined by a rotor and a stator;

rotating the rotor as the wet material flows through the grinding gap to reduce the average particle size of at least the one of the ingredients in the wet mixture;

flowing the wet mixture from the grinding gap through a chamber containing grinding media;

agitating said grinding media as the mixture flows through the chamber to further reduce the average particle size of at least the one ingredient; and processing the mixture from the chamber into gas generating particles.

2. A process as defined in claim 1 wherein said ingredients comprise a metal azide and a metal oxide.

3. A process as defined in claim 2 wherein said metal azide has an average particle size prior to flowing through said gap of about 180 microns, and the average particle size of said metal azide is reduced as it flows through said gap to about 80 microns.

4. A process as defined in claim 1 wherein said wet mixture is between 45% and 55% by weight solids.

5. A process as defined in claim 1 further including the step of cooling said wet mixture as it flows through said gap and as it flows through said chamber.

6. A process as defined in claim 3 wherein said metal oxide is iron oxide having an average particle size of about 0.2 microns, and the metal azide after flowing through the chamber has an average particle size of 1–5 microns.

7. A process as defined in claim 6 further including the step of making a gas generating grain for, when ignited, producing nitrogen gas to inflate an airbag.

8. A process comprising the steps of:

preparing a wet mixture of a metal azide having a predetermined average particle size and an oxidizer;

grinding the wet mixture to reduce at least the average particle size of the metal azide;

thereafter flowing the wet mixture through a chamber containing grinding media;

agitating said grinding media as the mixture flows through the chamber to further reduce the average particle size of the metal azide to a desired particle size; and processing the mixture from the chamber into gas generating particles.

9. A process as defined in claim 8 wherein said wet mixture flowing through said chamber is between 45% and 55% by weight solids.

10. A process as defined in claim 9 further including the step of cooling the wet mixture as it flows through said chamber.

11. A process as defined in claim 10 wherein said desired average particle size is 1–5 microns.

12. A process as defined in claim 11 further including the step of making a gas generating grain for, when ignited, producing nitrogen gas to inflate an airbag.

13. A process for manufacturing a gas generating material comprising the steps of:

preparing a wet mixture of a gas generating material;

grinding the wet mixture to a predetermined average particle size;

thereafter flowing the wet mixture having the predetermined average particle size through a chamber containing grinding media;

agitating the grinding media as the mixture flows through the chamber to reduce the predetermined average particle size of the wet mixture to a desired average particle size; and processing the wet mixture from the chamber into gas generating particles.

14. A process as defined in claim 13 wherein said wet mixture is 45% to 55% by weight solids.

15. A process as defined in claim 14 wherein said grinding step includes the steps of directing the wet mixture through a grinding gap defined by a rotor and a stator and rotating the rotor as the wet mixture flows through the gap.

16. A process as defined in claim 15 further including the step of cooling the wet mixture a it flows through the gap and as it flows through the chamber.

* * * * *